US007121266B2

(12) United States Patent
Powell

(10) Patent No.: US 7,121,266 B2
(45) Date of Patent: Oct. 17, 2006

(54) FUEL PUMP CUTOFF SHUTTLE VALVE

(75) Inventor: Patrick Powell, Farmington Hills, MI (US)

(73) Assignee: Denso International America, Inc., Southfield, MI (US)

( * ) Notice: Subject to any disclaimer, the term of this patent is extended or adjusted under 35 U.S.C. 154(b) by 232 days.

(21) Appl. No.: 10/952,509

(22) Filed: Sep. 28, 2004

(65) Prior Publication Data

US 2006/0065249 A1 Mar. 30, 2006

(51) Int. Cl.
*F02M 39/00* (2006.01)
*E03B 11/00* (2006.01)

(52) U.S. Cl. ..... 123/509; 123/457; 123/510; 137/112; 137/265

(58) Field of Classification Search ..... 123/509, 123/510, 511, 457; 137/112, 113, 265
See application file for complete search history.

(56) References Cited

U.S. PATENT DOCUMENTS 3,625,240 A * 12/1971 MacDuff ..... 137/113
4,141,280 A * 2/1979 Lorimor ..... 91/29
4,683,864 A * 8/1987 Bucci ..... 123/575
4,860,714 A * 8/1989 Bucci ..... 123/514
5,325,669 A * 7/1994 Barker et al. ..... 60/428
5,513,732 A * 5/1996 Goates ..... 192/3.3
5,636,654 A * 6/1997 Helm ..... 137/15.01
5,840,147 A * 11/1998 Grimm ..... 156/272.2
5,960,809 A * 10/1999 Keller ..... 137/12
6,250,894 B1 * 6/2001 Dyer et al. ..... 417/279
6,276,342 B1 * 8/2001 Sinz et al. ..... 123/514
6,283,142 B1 * 9/2001 Wheeler et al. ..... 137/265
6,371,149 B1 4/2002 Gust et al.
6,502,804 B1 1/2003 Schwegler et al.
6,684,829 B1 2/2004 Gebauer et al.

* cited by examiner

*Primary Examiner*—Thomas Moulis
(74) *Attorney, Agent, or Firm*—Harness, Dickey & Pierce, PLC

(57) ABSTRACT

A fuel pump cutoff shuttle valve is located between a multiple fuel pump arrangement. The valve has a first tubular member with a hollow, biased sliding member inside that moves according to the fuel pressures of the pumps. The fuel that flows through the valve member passes out through a valve member central orifice so that the fuel can flow into the second tubular member en route to an engine. When the fuel pressure in a pump greatly exceeds that of another pump on the opposite side of the valve member, the valve member moves and places the valve member central orifice adjacent to the interior wall of the first tubular member, stopping the flow of fuel. Alternatively, the valve member may have an orifice at each end of the valve member to permit a reduced flow of fuel to the engine when fuel is not supplied by the central orifice.

20 Claims, 3 Drawing Sheets

FUEL PUMP CUTOFF SHUTTLE VALVE

FIELD OF THE INVENTION

The teachings of the present invention relate to fluid delivery systems for delivering fluid to an device such as an internal combustion engine. Specifically, the teachings of the present invention relate to a fluid pump cutoff shuttle valve that is spring counterbalanced between fuel flow inputs in a multiple pump arrangement.

BACKGROUND OF THE INVENTION

Major fuel system components used in vehicles for delivering fuel to an internal combustion engine include an engine, a common rail, fuel lines, a fuel pump, and a valve disposed in a fuel line between the engine and the fuel pump.

While current fuel systems have generally proven to be satisfactory for their applications, each is associated with its share of limitations. One major limitation with many current fuel systems relates to the delivery of fuel from the fuel pump to the engine. More specifically, in a multiple fuel pump arrangement, when the pumping action of one of the pumps is compromised, current valves are incapable of completely terminating fuel flow to the engine. This presents a fuel supply situation in which the air to fuel ratio to the engine is compromised, which results in less than optimal combustion such as lean burn combustion.

Another limitation of current multiple fuel pump fuel systems is their inability to maintain fuel flow, after the failure of one pump, only to the extent necessary to maintain combustion and permit a vehicle to travel in order to move or to receive service. The inability of dual fuel pump fuel system valves to offer this feature results in vehicle engines that are incapable of operating in order to permit a vehicle to move off of a roadway or reach service.

What is needed then is a device that does not suffer from the above limitations. This in turn will provide a device that eliminates the problem of fuel flowing through a fuel valve from a first fuel pump of a dual fuel pump arrangement when a second pump ceases to operate, thereby preventing an engine from operating under a less than optimal combustion condition such as lean burn combustion. Furthermore, a device will be provided to successfully stop the flow of fuel from all fuel pumps of a multiple fuel pump arrangement when any of the pumps ceases to operate. Additionally, it is desired that in the event of a failure of a first pump in a dual fuel pump arrangement, the device will permit the second pump to discharge just enough fuel to the engine to support combustion to permit a vehicle to move.

SUMMARY OF THE INVENTION

In accordance with the teachings of the present invention, a fuel pump cutoff shuttle valve for stopping fuel flow to the engine when only one fuel pump of a dual fuel pump arrangement is capable of operation, is disclosed. In alternative teachings, the fuel pump cutoff shuttle valve will maintain a reduced fuel flow to the engine from the total output of one pump in the event that only one fuel pump of a dual fuel pump fuel system is operating.

In one preferred embodiment, the fuel pump cutoff shuttle valve is situated within a first tubular member that receives liquid fuel from dual fuel pumps and then transfers the liquid fuel to a second tubular member for subsequent transfer to the engine. The shuttle valve mechanism utilizes a hollow valve member within the first tubular member. The hollow valve member receives fuel at each of its ends, each end receiving fuel from a different fuel pump of a dual fuel pump arrangement. During standard operation, when the fuel is being pumped from each fuel pump into the first tubular member with its valve member, the fuel flows are combined and passed through an orifice in the center of the valve mechanism and then into the second tubular member.

The valve member is centered in the first tubular member by a spring on each side of the valve mechanism if no fuel is flowing. Additionally, constant and equal fuel pressure of each fuel pump assists in keeping the valve member centered. When fuel pressure from one of the pumps drops below that of the other fuel pump, such as when one pump stops operating, the combined force from the pump pressure and the spring on the side of the valve mechanism where the pump is still operating, forces the valve mechanism toward the fuel pump that has experienced a drop in pressure. This causes the valve mechanism with its center orifice to be forced to one side of the first tubular member, thereby completely stopping the flow of fuel from both fuel pumps due to blockage of the orifice by the first tubular member wall. This prevents the engine from experiencing inefficient combustion. That is, if the engine is not receiving the proper flow rate of fuel, the engine cannot support proper combustion, resulting in inefficient combustion. This first embodiment stops the flow of fuel, and thus the engine and potential inefficient combustion.

In a second preferred embodiment, the valve member has an orifice in each collar located at opposite ends of the valve member. These collar orifices permit a volume of fuel to pass from the valve member in the first tubular member into the second tubular member and then to the engine, even when one fuel pump is not operating. This reduced volume of fuel from one operating pump will permit limited function of a vehicle engine in order to move a vehicle prior to servicing.

The use of the present invention provides a fuel pump cutoff shuttle valve with a valve member that is capable of moving within a tubular member to prevent the flow of fuel or maintain a reduced flow rate of fuel to an engine when one fuel pump in a dual fuel pump arrangement either stops pumping or becomes impaired. As a result, the aforementioned limitations of available fuel pump systems and associated valves have been substantially reduced.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses. Moreover, while the teachings of the present invention are described in detail below generally with respect to automotive fuel delivery systems and their association with internal combustion engines, it will be appreciated by those skilled in the art that the teachings of the present invention are clearly not limited to only an automotive fuel system or automotive internal combustion engine fuel system, and may be applied to various other types of fuel systems for other combustion engines such as diesel fuel systems, liquid petroleum (LP) fuel systems, and the like, as further discussed herein.

Figure 1:
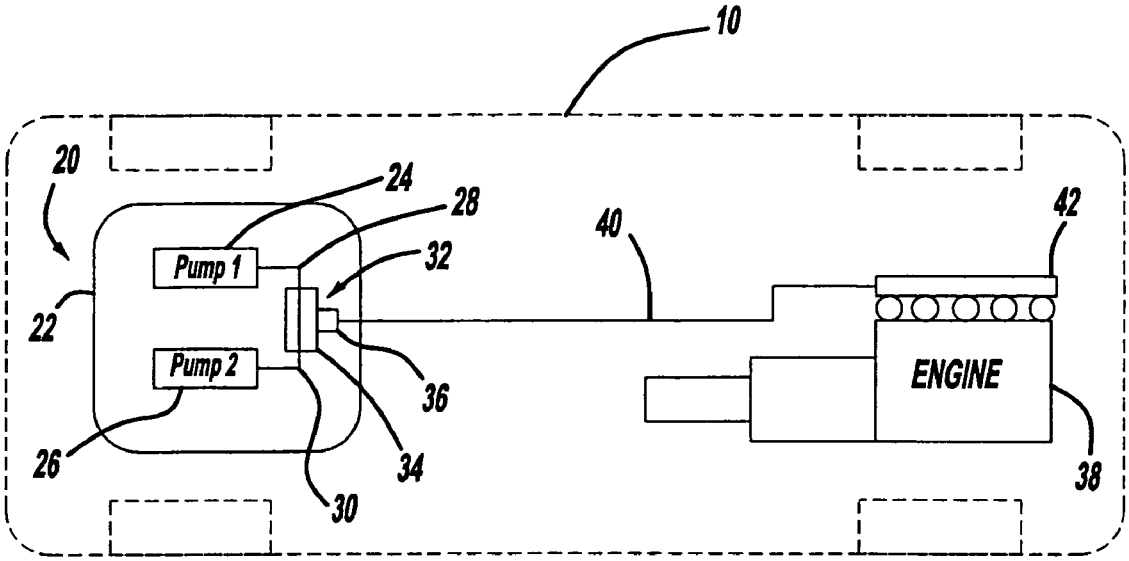
FIG. 1 is a perspective view of a vehicle fuel delivery system and its general location within a vehicle according to teachings of a first embodiment of the present invention.

Referring to FIG. 1, a vehicle 10 is depicted, showing, a vehicle fuel system 20 and its associated parts in accordance with the teachings of the present invention. The fuel system 20 of FIG. 1 is shown to include a fuel tank 22, a first fuel pump 24, a second fuel pump 26, a first fuel pump fuel line 28, and a second fuel pump fuel line 30. The first fuel line 28 and the second fuel line 30 both lead into opposite ends of a T-joint 32, which is made up of a first tubular member 34 and a second tubular member 36. As shown in FIG. 1, the two-pump fuel system consists of fuel pump 24 and fuel pump 26 to provide fuel to the engine 38. The fuel flow from both pumps is brought together inside the fuel tank 22 at the T-joint 32 and from there fuel is delivered in a single flow through a fuel line 40 to a fuel rail 42, or multiple fuel rails, and subsequently, to the engine 38. At the engine 38, the fuel is combusted to provide energy to the vehicle 10.

Figure 2:
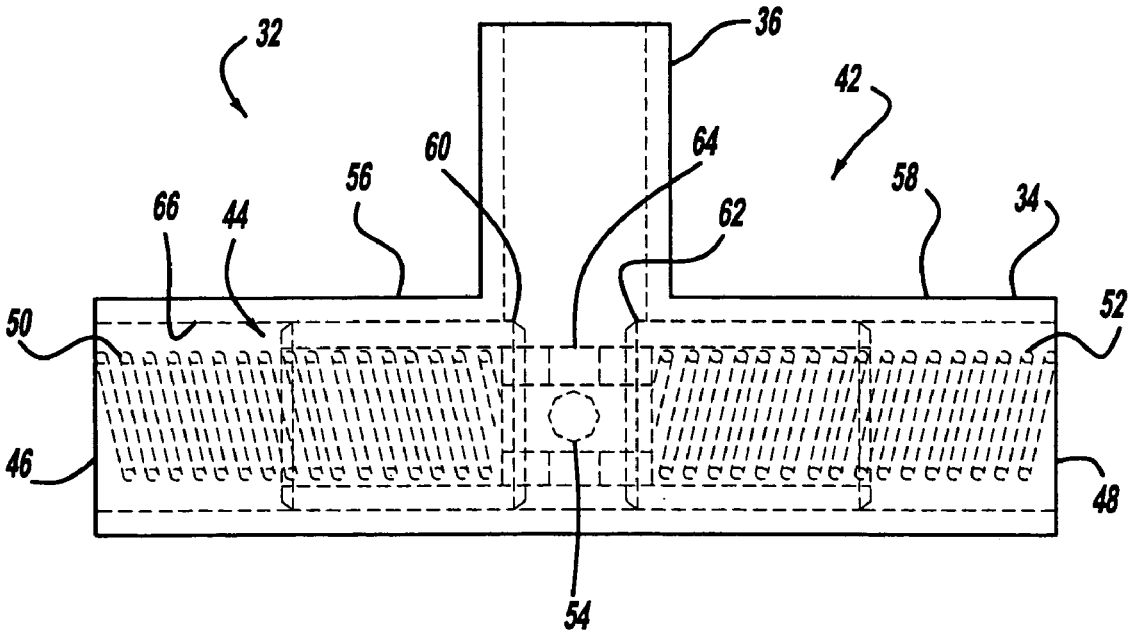
FIG. 2 is a top view of a T-joint and shuttle valve according to teachings of the first embodiment of the present invention.

The T-joint 32 design incorporates a shuttle valve 42 as shown in FIG. 2. The shuttle 44 is positioned between a first fuel inlet 46 and a second fuel inlet 48 by using a first spring 50 and a second spring 52. The springs 50, 52 possess sufficient strength to hold the shuttle 44 in a central position within the first tubular member 34 of the T-joint 32 when the pumps 24, 26 are not operating. The first tubular member 34 is joined to the second tubular member 36 to permit fluid to flow between them. Normally liquid fuel flows from the first tubular member 34 into the second tubular member 36. The second tubular member 36 divides the first tubular member 34 into a first side 56 and a second side 58. Therefore, when the shuttle 44 is centrally positioned, such as when the fuel pumps 24, 26 are not pumping fuel, the shuttle 44 is located such that the orifice 54 of the central portion 64 of the shuttle 44 is directly in line with the central axis of the second tubular member 36 to permit the free flow of fuel into the second tubular member 36. This also means that the first half 60 of the shuttle 44 resides within the first side 56 of the first tubular member 34, and the second half 62 of the shuttle 44 resides in the second side 58 of the first tubular member 34.

Operation of the shuttle valve 42 will now be explained according to teachings of the first embodiment of the present invention. When both fuel pumps 24, 26 are pumping at the same pressure, fuel enters the first tubular member 34 at the first fuel inlet 46 and the second fuel inlet 48 and exits through a single orifice 54 before passing into the second tubular member 36. The shuttle valve 42 is designed so that as long as fuel pressure on either side of the shuttle 44 is equal, the shuttle 44 will remain in its central position relative to the second tubular member 36. This means that the central portion 64 of the shuttle 44 is centrally located with respect to the central axis of the second tubular member 36. This central position is the normal position of the shuttle 44 and does not change unless one of the fuel pumps 24, 26 stops operating or experiences a significant decrease or increase in fuel pressure, relative to its counterpart pump.

Figure 3:
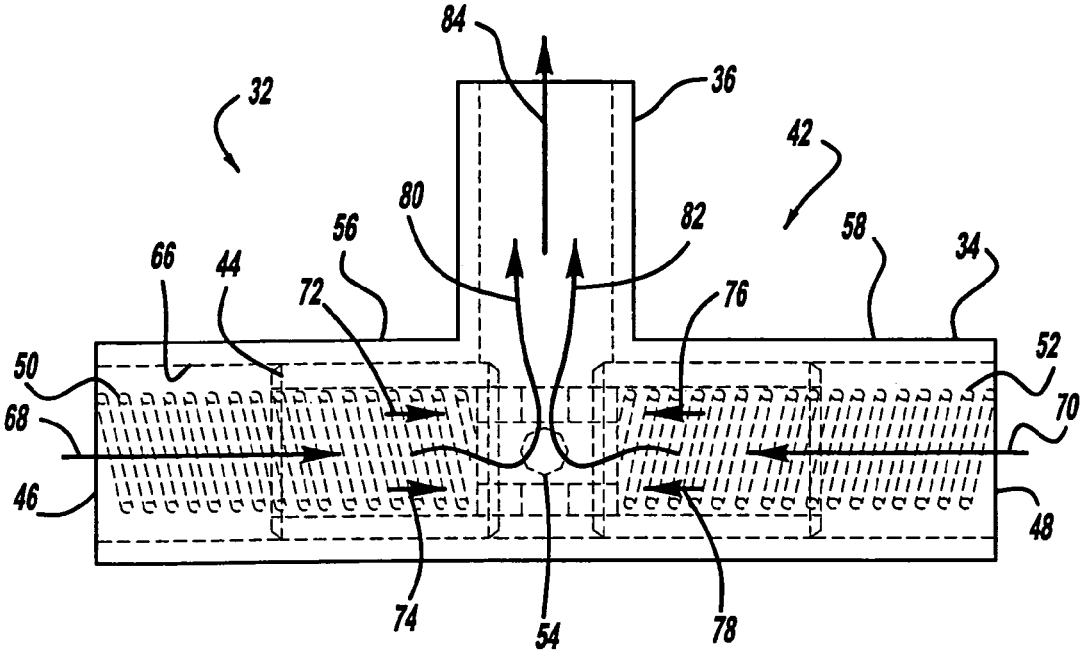
FIG. 3 is a top view of a T-joint and shuttle valve showing fuel flow inlets and spring forces according to teachings of the first embodiment of the present invention.

Referring to FIG. 3 and assuming a fuel flow of constant fluid fuel pressure from the fuel pumps 24, 26, fuel flows into the first side 56 of the first tubular member 34 through the first inlet 46 as shown by the arrow 68, while fuel flows into the second side 58 of the first tubular member 34 through the second fuel inlet 48 as shown by the arrow 70. The fuel pressure from the first pump 24 exerts a force on the first side 56 of the shuttle 44 as noted by the force arrows 72, 74, while the fuel pressure from the second pump 26 exerts a force on the second side 58 of the shuttle 44 as noted by the force arrows 76, 78. In addition to the force resulting from the fuel pressure, the springs 50, 52 also exert a force on their respective sides of the shuttle 44. Therefore, when fuel flows into the first tubular member 34 and subsequently, into the shuttle 44, it is forced to exit the shuttle 44 through the orifice 54. The exiting fuel from the orifice 54, shown by the flow arrows 80, 82, combines to form a single flow of fuel 84 which continues to the engine 38. The above depiction represents fuel delivery when the flow of fuel is being delivered at equal and constant pressures from the fuel pumps 24, 26. A different situation presents itself when fuel is not delivered at a constant pressure, as noted in the second embodiment.

Figure 4:
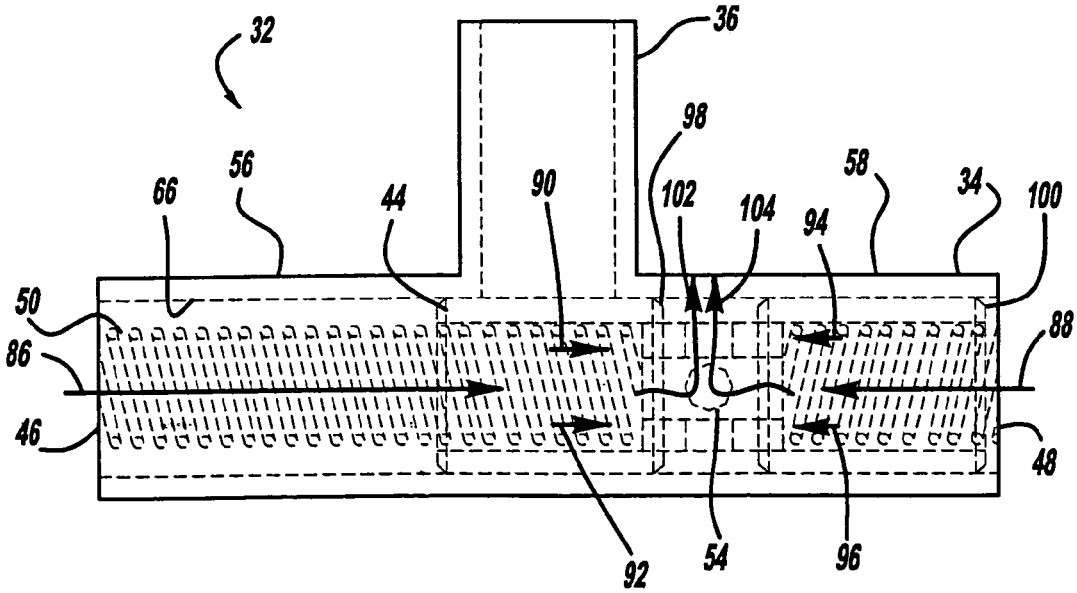
FIG. 4 is a top view of a T-joint and shuttle valve showing how the shuttle moves when the fuel pressure of a first pump is greater than the fuel pressure of a second pump.

When the pumping action of the fuel pumps 24, 26 varies during operation, the difference in fuel pressure causes different forces to act on each side of the shuttle 44. This disparity in forces causes the shuttle 44 to slide along the inside surface 66 of the first tubular member 34. Since the first spring 50 and the second spring 52 supply equal forces to the shuttle 44, the disparity in forces caused by the difference in fuel pressure from the fuel pumps 24, 26 is what causes the shuttle 44 to move along the inside surface 66 of the first tubular member 34. FIG. 4 is an example of how the shuttle 44 moves when the fuel pressure of the first pump 24 is greater than the second pump 26, assuming that the second pump 26 significantly reduces its output for some reason.

As shown in FIG. 4, the pressure of the first pump 24 is such that it causes fuel to flow according to flow arrow 86. The fuel pressure causes a force to be generated, which is combined with the force of the first spring 50 in generating a combined force against the first side 56 of the shuttle 44. During the time that the first pump is operating, the second pump 26 ceases to pump at the pressure at which the first pump 24 is operating. This reduced flow rate is noted by flow arrow 88. Due to the reduced flow, the force against the second side 58 of the shuttle 44 is also reduced. The reduced force is noted by the force arrows 94, 96. Because of this disparity in force, the shuttle moves away from the first side 56 and toward the second side 58 of the first tubular member 34. This change in position of the shuttle 44 is shown in FIG. 4.

At the position of the shuttle 44 in FIG. 4, an object of the teachings of the present invention is satisfied. An object of the teachings is to stop the flow of fuel to the engine in the event that one pump in a dual fuel pump fuel system ceases to operate or is significantly different in its output pressure compared to its counterpart pump. As depicted in FIG. 4, the flow of fuel 102, 104 out of the orifice 54 is directed at the inside surface 66 of the first tubular member 34. This stops the flow of fuel to the engine 38, since the seal between the shuttle 44 and the inside surface 66 of the first tubular member 34 prevents the passage of fuel, and with that seal in place, the fuel has no outlet. Stopping the flow of fuel to the engine 38 prevents an undesirable air to fuel ratio during combustion within the engine 38. As an alternative to this configuration, FIG. 5 presents a configuration in which an amount of fuel is delivered to the engine 48 even when the pumping efficacy of one pump 26 in a dual pump system 24, 26 is compromised.

Figure 5:
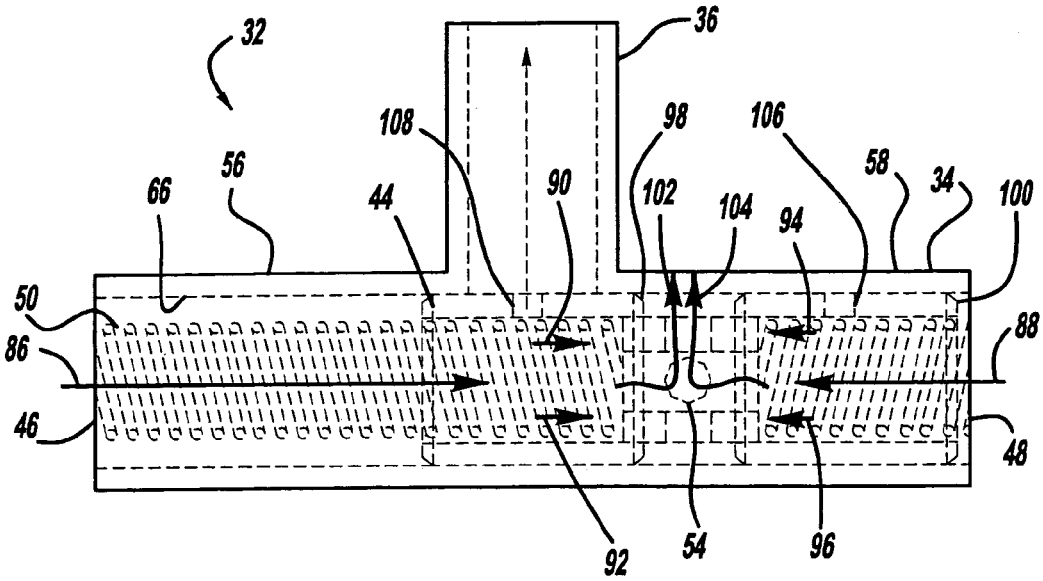
FIG. 5 is a top view of a T-joint showing fuel orifices in the ends of the shuttle valve according to teachings of a second embodiment of the present invention.

FIG. 5 depicts a situation in which an amount of fuel is delivered to the engine 48 even when the pumping effectiveness of one pump 26 in a dual pump system 24, 26 is compromised or stops pumping. The reduced flow of fuel is shown by the dashed arrow coming from orifice 108. As shown in FIG. 5, the pressure of the first pump 24 is such that it causes fuel to flow according to flow arrow 86. The fuel pressure causes a force to be generated, which is combined with the force of the first spring 50 in generating a combined force against the first side 56 of the shuttle 44. During the time that the first pump is operating, the second pump 26 ceases to pump at the pressure at which the first pump 24 is operating. This reduced flow rate is noted by flow arrow 88. Due to the reduced flow, the force against the corresponding side of the shuttle 44 is also reduced, which is noted by the force arrows 94, 96. Because of this disparity in force, the shuttle 44 moves away from the first side 56 and toward the second side 58 of the first tubular member 34 as shown in FIG. 5.

At the position of the shuttle 44 in FIG. 5, another object of the teachings of the present invention is evident. That object of the teachings is to stop the flow of fuel coming from the orifice 54 in the event that one pump in a dual fuel pump fuel system ceases to operate or is significantly different in its pressure output compared to its counterpart pump. However, the object is compound, and as can be seen in FIG. 5, since the shuttle has an orifice 108 in the first side 98 of the shuttle 44, and an orifice 106 in the second side 100 of the shuttle 44. These orifices 106, 108 are located in the collars at the ends of the shuttle 44 and permit fuel to flow to the engine 48 even when the flow of fuel from the centrally located orifice 54 has been stopped. As seen in FIG. 5, the flow of fuel, as noted by the dashed line from the orifice 108, continues from orifice 108 when fuel is delivered from the first pump 24, even when the pumping action of the second pump 26 has ceased or the second pump's pumping pressure has been compromised relative to the first pump 24. The advantage of this second embodiment is that even though the pumping action of one pump has been compromised, and the main flow of fuel has stopped, that is, the main flow of fuel from the central orifice 54, the flow coming from a collar orifice 108 permits the engine to operate so that a vehicle can be moved to obtain service or be repositioned.

Although the second embodiment has been depicted with the first pump 24 as the pump that continues to operate and the second pump 26 as the pump that stops pumping or has its pumping pressure compromised, the opposite could occur and result in the same advantage. That is, the second pump 26 could continue to pump at a steady or constant pressure necessary for approximately 50% of the required engine and vehicle performance, with the first pump 24 experiencing a reduced pumping pressure relative to the second pump 26. In this situation, the shuttle 44 would be forced toward the first side 56 of the first tubular member 34 and although fuel would stop exiting from the orifice 54 because the orifice 54 would face the inside surface 66 of the first tubular member 34, fuel would be able to pass through collar orifice 106 because of its alignment with the second tubular member 36. This second scenario is not shown in the figures since it is a mirror image of FIG. 5.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus for passing fluid comprising:

a first tubular member;

a second tubular member, said second tubular member being connected to said first tubular member such that said second tubular member defines a first side of said first tubular member and a second side of said first tubular member and permits fluid communication between said first tubular member and said second tubular member;

a valve member located within said first tubular member, said valve member defining a through passage for transporting fluid within said valve member and said first tubular member, wherein said valve member moves according to a fluid pressure on a first end of said valve member and a fluid pressure on a second end of said valve member and directs the flow of fluid according to such pressure.

2. The apparatus according to claim 1, further comprising:

a first biasing member that biases against said first end of said valve member; and a second biasing member that biases against said second end of said valve member, wherein said first and said second biasing members center said valve member relative to said second tubular member.

3. The apparatus according to claim 2, wherein said first end of said valve member encompasses a portion of said first biasing member.

4. The apparatus according to claim 2, wherein said second end of said valve member encompasses a portion of said second biasing member.

5. The apparatus according to claim 1, wherein said valve member defines an orifice, said valve member orifice permitting fluid to flow from said first tubular member to said second tubular member.

6. The apparatus according to claim 1, wherein said valve member orifice is located proximate to said second tubular member.

7. The apparatus according to claim 1, wherein said valve member moves perpendicularly to said second tubular member.

8. The apparatus according to claim 1, the apparatus further comprising:

a first collar portion located at said first end; and a second collar portion located at said second end.

9. The apparatus according to claim 8, wherein when said first collar portion is within said second side of said first tubular member, said valve member orifice directs fuel toward said first tubular member wall preventing fuel flow from said valve member orifice.

10. The apparatus according to claim 9, wherein said first collar portion defines a first collar orifice.

11. The apparatus according to claim 9, wherein said second collar portion defines a second collar orifice.

12. The apparatus according to claim 10, wherein when a portion of said first collar portion is within said second side of said first tubular member, fuel flows from said first collar orifice to said second tubular member.

13. The apparatus according to claim 11, wherein when a portion of said second collar portion is within said first side of said first tubular member, fuel flows from said second collar orifice to said second tubular member.

14. A fuel pump shuttle valve comprising:

a first tubular member containing a movable cylindrical valve member, said cylindrical valve member defining a through passage in said valve member's longitudinal direction and defining a valve member orifice perpendicular to said valve member's longitudinal direction to permit fluid to pass from said through passage to said valve member orifice;

second tubular member directly connected to and dividing said first tubular member into a first side and a second side such that said second tubular member receives fluid from said first side and said second side of said first tubular member;

first biasing member that applies force against a first end of said cylindrical valve member to bias said cylindrical valve member in a first direction; and second biasing member that applies force against a second end of said cylindrical valve member to bias said cylindrical valve member in a second direction, said second direction opposite to said first direction, wherein said cylindrical valve member slides against an inner wall surface within said first tubular member, said cylindrical valve member longitudinally positioned within said first tubular member according to a fluid pressure acting at said first end, a fluid pressure acting at said second end, and forces from said first and second biasing members.

15. The fuel pump shuttle valve of claim 14, further comprising:

a raised first collar at said first end of said cylindrical valve member, said raised first collar in contact with said first side of said first tubular member; and a raised second collar at said second end of said cylindrical valve member, said raised second collar in contact with said second side of said first tubular member.

16. The fuel pump shuttle valve of claim 15, wherein when said first collar portion and said second collar portion are both on said first side of said first tubular member, said first tubular member does not transmit fluid to said second tubular member.

17. The fuel pump shuttle valve of claim 16, further comprising:

a first collar orifice defined in said first collar portion to permit fluid transfer between said first tubular member and said second tubular member, when said valve member orifice is positioned toward said inner wall of said first tubular member.

18. A fuel delivery system comprising:

an engine;

a fuel line that delivers fuel to said engine after passing through a fuel rail;

a fuel tank containing a first fuel pump and a second fuel pump, said first fuel pump situated on a first side of a T-joint and delivers fuel to said T-joint from said first side of said T-joint, and said second fuel pump is situated on a second side of said T-joint and delivers fuel to said T-joint from said second side of said T-joint, said T-joint comprising a first tubular member and a second tubular member, said second tubular member fluidly connected to said fuel line; and a hollow valve member situated within said first tubular member and defining a valve member orifice at a central portion of said hollow valve member, said valve member orifice passing fuel from said hollow valve member to said second tubular member, wherein said hollow valve member is slidable within said first tubular member.

19. The fuel delivery system of claim 18, further comprising:

a first biasing member residing partially within a first end of said hollow valve member; and a second biasing member residing partially within a second end of said hollow valve member, wherein said first and second biasing members position said hollow valve member such that the longitudinal axis of said second tubular member equally divides said hollow valve member.

20. The fuel delivery system of claim 18, wherein a central portion of said hollow valve member is smaller in outside diameter than end outside diameters of said hollow valve member.

* * * * *